United States Patent [19]

Brown

[11] 4,394,876

[45] Jul. 26, 1983

[54] CONTAINER FILLING MACHINE

[75] Inventor: Jonathan G. Brown, Rockford, Ill.

[73] Assignee: Anderson Bros. Mfg. Co., Rockford, Ill.

[21] Appl. No.: 316,982

[22] Filed: Nov. 2, 1981

[51] Int. Cl.[3] ..... B65B 3/04

[52] U.S. Cl. ..... 141/137; 141/140; 141/234; 141/284

[58] Field of Search ..... 141/100–110, 141/129–192, 250–284, 234–248

[56] References Cited

U.S. PATENT DOCUMENTS 2,863,271 12/1958 Anderson et al. .
3,055,404 9/1962 Anderson .
3,307,499 3/1967 Bergstrom .

*Primary Examiner*—Houston S. Bell, Jr.
*Attorney, Agent, or Firm*—Vernon J. Pillote

[57] ABSTRACT

A filling machine for filling containers as they are advanced by a conveyor. Valved dispenser assemblies are moved in an upright closed loop course above the conveyor and move in the direction of advance of the conveyor during the lower half of the closed loop course and in the opposite direction during the upper half of the closed loop course. Fluid pressure operated valve actuators are provided for operating the valves on the dispensers between their open and closed positions and control mechanism is provided to control application of fluid pressure to the valve actuators in timed relation to the movement of the dispenser assemblies in their closed loop course. Provision is also made for no container-no fill operation.

13 Claims, 8 Drawing Figures

CONTAINER FILLING MACHINE

CROSS-REFERENCE TO RELATED APPLICATIONS

This application is related to U.S. application Ser. No. 06/251, 250 filed Apr. 6, 1981, now U.S. Pat. No. 4,375,826, and assigned to the assignee of the present invention.

BACKGROUND OF THE INVENTION

In the above referenced application, there is disclosed an apparatus for filling containers as they are advanced by a conveyor. The dispensing apparatus includes a dispenser body having a product inlet and a product outlet and a dispenser valve means for controlling flow from the product inlet to the product outlet. The dispenser body is moved in a generally upright closed loop course having horizontal and vertical components of movement and such that the product outlet moves in the direction of advance of the containers on the conveyor as the dispenser moves through the lower portion of its closed loop course and in the opposite direction during the upper portion of its closed loop course. In the apparatus disclosed in the above referenced application, a valve actuator means is operated in response to the vertical component of movement of the dispenser body to move the dispenser valve means between its open and closed positions.

Such valved dispenser apparatus are operative to dispense product only while the dispenser body is moving through the lower half of its closed loop course and, as disclosed in the aforementioned application, at least two valved dispenser apparatus are advantageously provided and operated out of phase with each other such that dispensing of product from one valved dispenser commences as the dispensing of product from another valved dispenser is shut off to achieve a more uniform rate of flow of product from the supply source and to also effect more rapid filling of the containers.

However, movement of the dispensing valve means between its open and closed position in response to the vertical component of movement of the dispensers body as it is moved in a closed loop course produces a somewhat gradual opening and closing of the dispensing valve means and some problems have been encountered with product spurting and dripping from the dispenser outlet. This is believed to be due to the gradual and non-linear increase and decrease in the rates of flow through the dispenser outlets as the dispenser valves move toward their closed and open positions. In addition, the valve actuator means in that application operated the dispenser valve mechanically in response to the vertical component of movement of the dispenser body, and the filling machine in that application had no provision for preventing dispensing of product in the absence of a container as the conveyor advanced past the dispenser.

SUMMARY OF THE INVENTION

It is the object of the present invention to overcome the disadvantages of the prior art by providing a container filling machine in which a valved dispenser assembly is moved in a closed loop course above the conveyor so that the dispenser outlet moves in the direction of advance of the containers during the lower half of the closed loop course to dispense a product into the containers while they are in motion, and which has an improved arrangement for operating the dispenser valve to effect a rapid opening and closing of the valve at the beginning and end of a dispensing operation.

Another object of this invention is to provide a filling machine in accordance with the foregoing object and which can be readily adapted to prevent dispensing of product in the absence of a container.

Accordingly, the present invention provides a container filling machine having a conveyor for advancing containers along a generally horizontal path and at least one valved dispenser assembly for dispensing product into the containers as they are advanced by the conveyor, the valved dispenser assembly including a body having a product inlet and a downwardly opening product outlet and dispenser valve means on the dispenser body movable relative thereto between a closed position blocking flow from the product inlet to the product outlet and an open position for passing product from the product inlet to the product outlet, dispenser mounting means including a crank mounted for rotation about a generally horizontal crank axis and having an eccentric connected to the dispenser body to move the body in a generally upright closed loop course, means for driving the crank in timed relation to the conveyor and such that the horizontal component of movement of the dispenser is in the direction of movement of the conveyor during the lower half of the closed loop course and in the opposite direction during the upper half of the closed loop course, and a fluid pressure operated valve actuator means mounted on the dispenser body for movement therewith and having an output member movable relative thereto and connected to the dispenser valve means for rapidly moving the dispenser valve means to its open position when the fluid pressure operated valve actuator means is operated to a first condition and for rapidly moving the dispenser valve means to its closed position when the fluid pressure operated valve actuator means is operated to a second condition, and control means for controlling application of fluid pressure to the fluid pressure operated valve actuator means to operate the fluid pressure operated valve actuator means to its first condition as the dispenser body moves through at least a portion of the lower half of its closed loop course and to operate the fluid pressure operated valve actuator means to its second condition during the remainder of the closed loop course.

Provision can be made for detecting the absence of a container in filling position below the dispenser assembly and for preventing the application of fluid pressure to the valve actuator means in the absence of a container.

These, together with other objects, features and advantages of this invention will be more readily understood by reference to the following detailed description when taken in connection with the accompanying drawings wherein.

Figure 1:
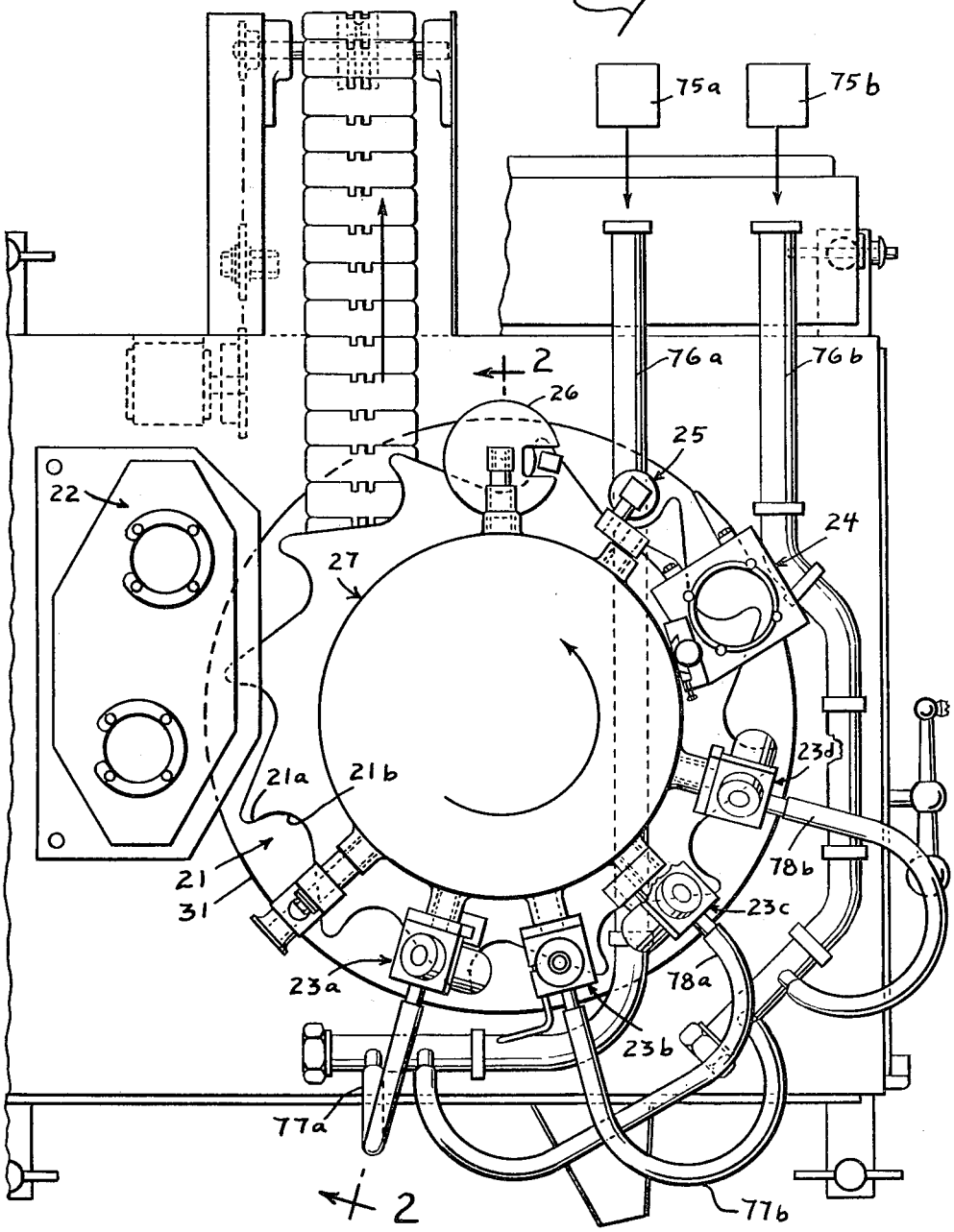
FIG. 1 is a top plan view of a filling machine.

The container filling apparatus of the present invention is arranged to fill containers as they are continuously advanced and, as best shown in FIG. 1, includes a conveyor 21 for advancing containers in continuous fashion along a generally horizontal path and at least one and preferably a plurality of valved dispenser assemblies, herein shown four in number and designated 23*a*–23*d*, arranged to dispense product into the containers as they are advanced by the conveyor. The filling machine can also conveniently include a container dispensing mechanism 22 for feeding empty containers to the conveyor, a cover dispenser mechanism 24 for dispensing covers, and a cover applying mechanism 25, 26 for applying the covers to the containers.

Figure 2:
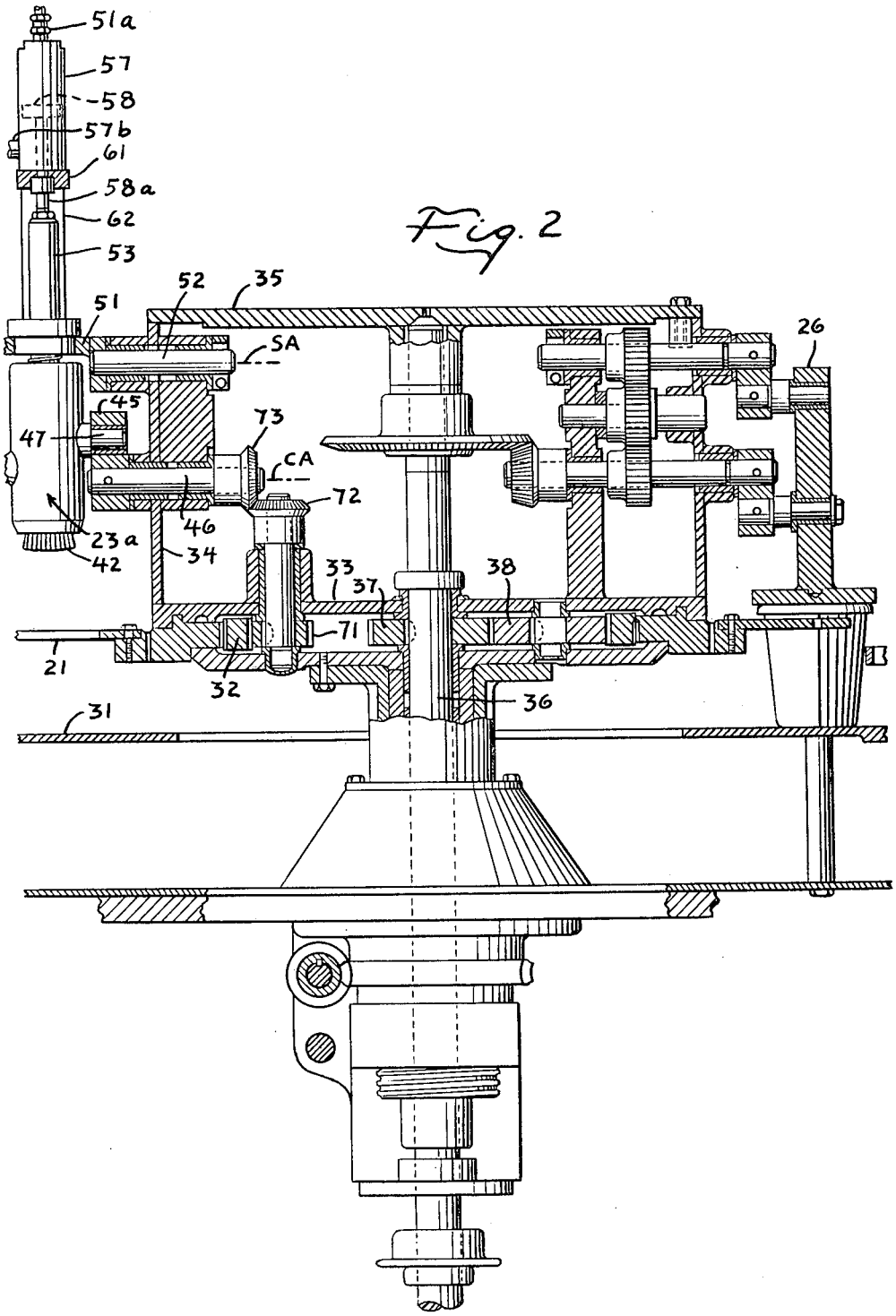
FIG. 2 is a vertical sectional view through the filling machine taken on the plane 2—2 of FIG. 1.

In the embodiment illustrated, the conveyor 21 and the drive therefor are of the type disclosed in U.S. Pat. No. 2,863,271 to which reference is hereby made for a more complete disclosure and description. In general, the conveyor 21 is annular in form and includes a plurality of outwardly extending teeth 21*a* that define container pockets 21*b* therebetween and which are arranged to advance containers along a generally horizontal container support platform 31. As best shown in FIG. 2, the conveyor 21 is mounted on a ring gear 32 that is rotatably supported on a stationary central housing 27 having a bottom wall 33, peripheral side walls 34 and top wall 35. A central vertically disposed drive shaft 36 is operatively connected to a drive motor (not shown) in a manner more fully disclosed in the aforementioned patent, and the drive shaft 36 is connected through spur gear 37 and idler gears 38 to the ring gear 32 to rotate the ring gear in response to rotation of the drive shaft 36.

The valved dispenser assemblies 23*a*–23*d* are of like construction and like numerals are used to designate corresponding parts. Each dispenser assembly includes a dispenser body 41 having a longitudinal dispenser axis indicated by the line DA in FIG. 3, with a product outlet 42 at its lower end and a product inlet 43 spaced from the nozzle outlet. The valved dispenser assemblies are mounted for movement in a generally upright closed loop course having horizontal and vertical components of movement and such that the product outlet moves in the direction of advance of the containers on the conveyor as the dispenser moves through the lower half of its closed loop course and in the opposite direction during the upper half of the closed loop course. The valved dispenser assemblies are preferably mounted in the manner disclosed in the above referenced application so that the product outlet moves in an oblate closed loop course. Each dispenser body is dirven in a crank 45 mounted on a shaft 46 rotatably supported on the side wall 34 of the stationary housing for rotation about a generally horizontal crank axis designated CA spaced above the conveyor. Each crank has an eccentric crank pin 47 which rotates in a circular path designated CP and which is connected to the dispenser body for relative rotary movement therebetween to move the dispenser body in a generally upright closed loop course having horizontal and vertical components of movement. Each dispenser assembly also includes a dispenser motion control means 51 mounted on the stationary housing 27 by a pin 52 and which supports the dispenser motion control means 51 for angular oscillation about a generally horizontal swing axis SA above the crank axis. A means is provided for connecting the dispenser body 41 and the dispenser motion control means 51 for relatively sliding movement in a direction paralleling the dispenser axis DA, to cause the dispenser body to oscillate angularly about the swing axis and reciprocate relative to the dispenser motion control means 51 as the dispenser body is moved in its closed loop course. In the embodiment illustrated, this means includes an elongated rod 53 that parallels the dispenser axis and which is slidably supported in a bearing 51*a* on the dispenser motion control means 51. With this dispenser assembly mounting, the dispenser outlet moves in an oblate closed loop course in which the horizontal component of movement of the outlet is substantially greater than double the crank throw and the vertical component of movement is substantially equal to twice the crank throw.

Figure 3:
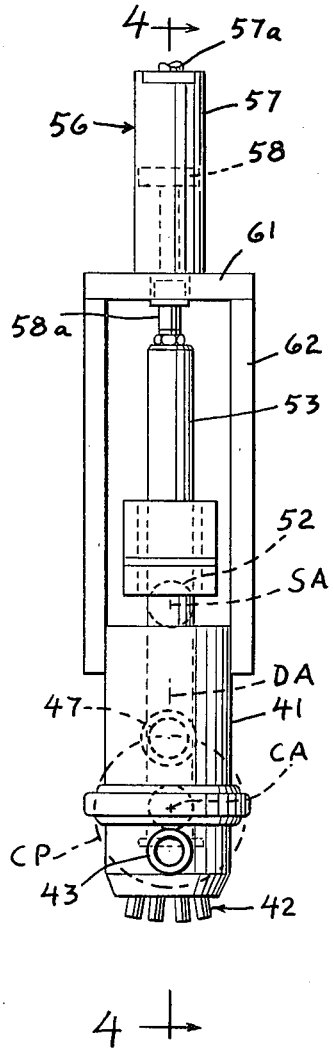
FIG. 3 is a front elevational view of one form of the dispensing valve.
Figure 4:
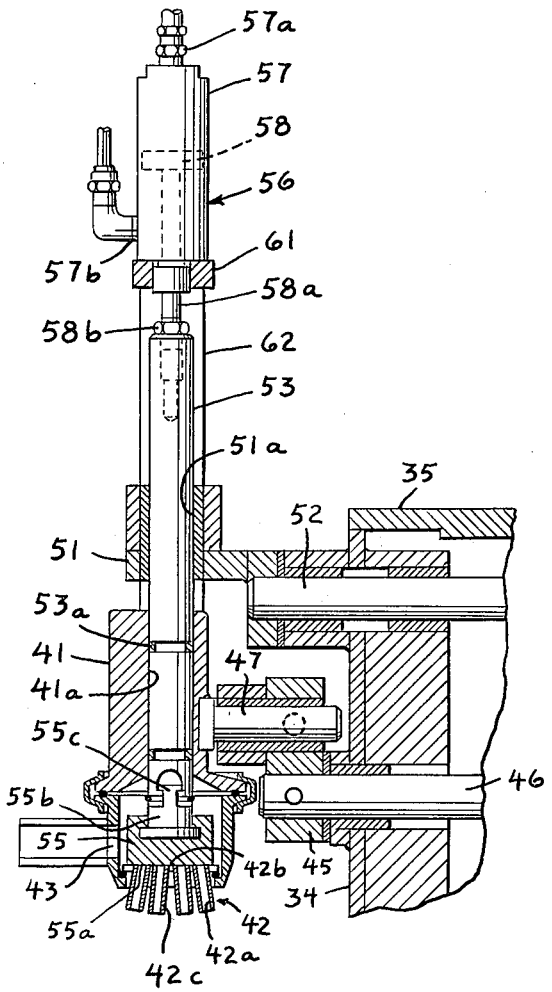
FIG. 4 is a vertical sectional view taken on the plane 4—4 of FIG. 3.

A dispenser valve 55 is provided on each dispenser body for controlling flow from the product inlet 43 to the product outlet 42. In the embodiment of FIGS. 3 and 4, the dispenser valve is mounted on the dispenser body for sliding movement relative thereto along a path paralleling the dispenser axis between its open and closed positions. The valve member 55 is mounted on the lower end of the rod 53 and the rod 53 is slidably supported in a bore 41*a* in the dispenser body for movement relative thereto along the dispenser axis DA. The product outlet means 42 on the dispenser body includes at last one and preferably a plurality of downwardly opening discharge ports 42*a* at the lower end of the dispenser body and a discharge valve seat means 42*b* disposed transverse to the dispenser axis and extending around each of the ports 42*a*. The valve member 55 is of the face seating type and has a valve face 55*a* disposed transverse to the dispenser axis and which is movable with the rod 53 into and out of engagement with the discharge valve seat 42*b* on the dispenser body. The valve member 55 is conveniently formed of resilient elastomeric material such as rubber or the like and has a mounting member 55*b* detachably keyed as 55*c* to the lower end of the rod 53. The rod is slidably sealed to the dispenser body as by O-ring seals 53*a*.

The face seal type valve is effective to prevent leakage of even low viscosity liquids through the ports when the valve is closed. However, in order to minimize splashing and foaming in the container and to inhibit dripping of low viscosity liquids from the nozzle when the valve member is closed, the discharge ports are preferably arranged to provide a plurality of elongated passages that direct the liquid in separate streams into the container. Each passage has a cross-section that is sufficiently small to substantially inhibit drainage of product therefrom when the valve is closed. In the embodiment illustrated, the product outlet means includes a plurality of tubes 42*c*, herein shown 14 in number, and having a relatively small internal diameter, preferably of the order of 0.180 inches. When dispensing more viscous products where splashing and foaming are not a problem, the product outlet means can be in the form of a single orifice or opening.

Figure 5:
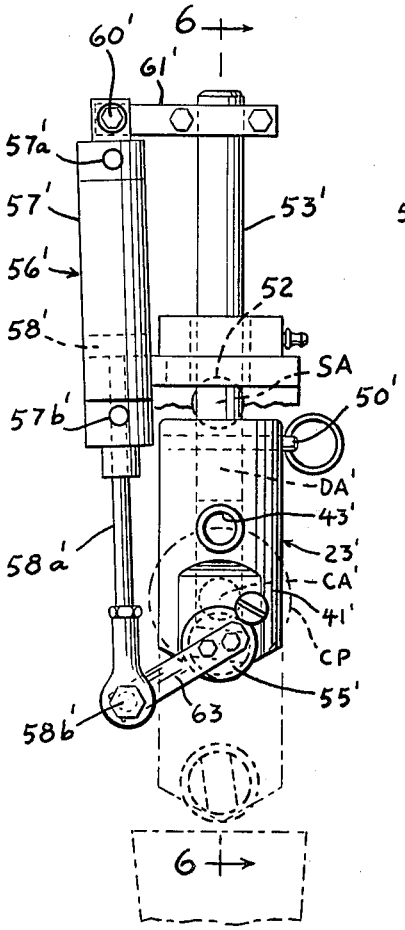
FIG. 5 is a front elevational view of another form of dispensing valve.
Figure 6:
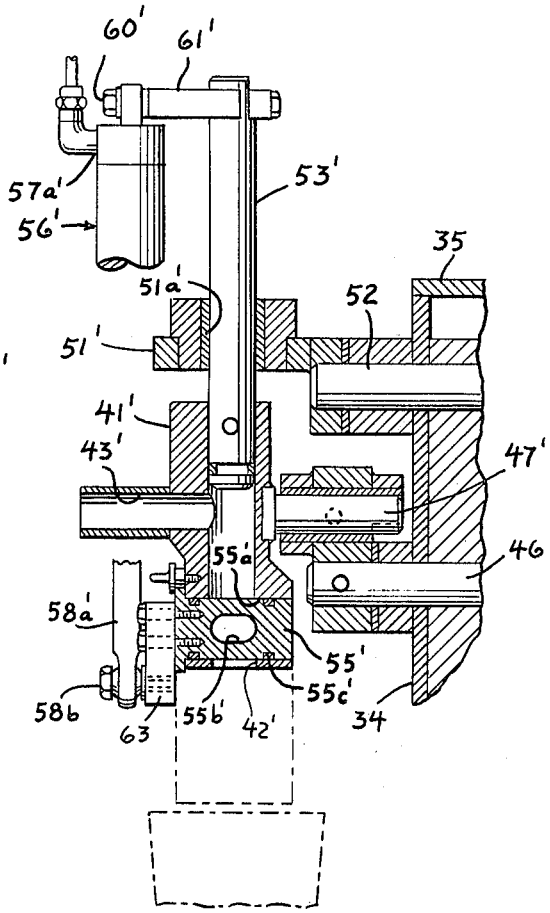
FIG. 6 is a vertical sectional view taken on the plane 6—6 of FIG. 5.

A modified form of valved dispenser assembly is illustrated in FIGS. 5 and 6. In this embodiment, like numerals are used to designate the same parts as described in connection with the embodiment of FIGS. 3 and 4, and like numerals followed by the postscript ′ are used to designate similar or modified parts. Each valved dispenser assembly 23' includes a dispenser body 41' having a dispenser axis DA' and a product outlet 42' at its lowr end and a product inlet 43' spaced from the product outlet. The dispenser body 41' is connected by an eccentric crank pin 47' to the crank 45 for movement in a generally upright closed loop course having horizontal and vertical components. A dispenser motion control means 51' is mounted on the pin 52 for angular movement about swing axis SA spaced above the crank axis CA and a rod 53' is connected to the nozzle member as by a pin 50' and is slidably supported in the bearing **51*a*' in the dispenser control means 51' to cause the nozzle member to oscillate angularly about the swing axis and reciprocate relative to the dispenser control means as the nozzle member is moved in its closed loop course by the crank means. In this embodiment, a plug type valve member 55' is mounted in a transverse bore 55*a*' in the dispenser for angular oscillation relative thereto. The plug member has a transverse flow passage 55*b*' which is movable between a closed position shown in FIGS. 5 and 6 out of communication with the product outlet 42', and an open position in which the passage 55*b*' registers with the product outlet. O-ring seals 55*c*' are provided on the plug valve member to seal against the bore 55*a*' at opposite sides of the flow passage 55*b*'**.

The crank of each valved dispenser assembly is driven in timed relation with the conveyor such that the horizontal component of movement of the nozzle member is in the direction of movement of the conveyor during the lower half of the closed loop course and in the opposite direction during the upper half of the closed loop course. As best shown in FIG. 2, the cranks 45 are driven as by a power take-off gear 71 that meshes with the conveyor ring gear 32, and through beveled gears 72 and 73.

Each valved dispenser assembly only dispenses product during the lower half of its closed loop course and the nozzle on the valved dispenser assembly is driven at a speed so that the horizontal component of the movement of the product outlet closely approximates the speed of movement of the container being advanced below the nozzle by the conveyor. The teeth **21*a* on the conveyor are arranged to advance the containers along the path with the centers of the containers spaced apart a preselected container pitch distance equal to the spacing of corresponding points on adjacent teeth. The first valved dispenser assembly 23*a* is driven at a speed to complete one revolution during the time the conveyor advances a distance corresponding to twice the conveyor pitch distance and is timed so that the nozzle outlet is at its bottom dead center position when the container being filled is substantially centered below the nozzle. Thus, the first valved dispenser will only dispense product into alternate ones of the containers. At least oneother valved dispenser assembly is accordingly provided and spaced along the conveyor path and driven in timed relation with the first mentioned valved dispenser so as to dispense product into containers intermediate those filled by the first valved dispenser assembly. In order to further increase the speed of filling, each valved dispenser assembly can be arranged to dispense only a portion of the total amount of product into each container. For example, if each valved dispenser assembly is arranged to dispense only one-half of the total amount of product, then four valved dispenser assemblies 23*a*–23*d* are provided with two of the valved dispenser assemblies such as 23*a* and 23*b* arranged to dispense product into the same container and two other valved dispenser assemblies 23*c* and 23*d* arranged to dispense product into different containers. When four valve dispenser assemblies are utilized, it is preferable to use two positive displacement type product pumps 75*a* and 75*b* and to connect one pump 75*a* through pipe 76*a* and flexible tubes 77*a* and 78*a* to two valved dispensers 23*a* and 23*c* that dispense into different containers and to connect the other pump 75*b* through pipe 76*b* and flexible tubes 77*b* and 78*b* to two other dispensers 23*b* and 23*d* that dispense into different containers. The positive displacement pumps 75*a* and 75*b* are driven from a motor through separate variable speed drives (not shown) to enable adjustment of the rate of delivery of product to the valved dispensers to vary the amount of material dispensed into the containers. The valve actuators 56** are adjusted to vary the portion of the cycle during which each valve means is open. Preferably the valve actuators for the pair of valved dispensers that are connected to the same product pump are adjusted so that the valve means on one valved dispenser commences opening just before the valve means on the other valved dispenser closes to thereby allow a substantially continuous flow of product from the product pump through one or the other of the valved dispensers connected thereto.

In accordance with the present invention, fluid pressure operated valve actuating means 56 is provided for moving the dispenser valves between their open and closed positions, and a control system is provided to control the application of fluid pressure to the fluid pressure valve actuating means in timed relation with the movement of the dispenser assembly in its closed loop course. The fluid pressure operated valve actuating means produces a rapid opening and closing of the dispensing valve. In addition, it enables the container filling machine to be adapted for no container-no fill operation.

The fluid pressure operated valve actuating means 56 includes a fluid cylinder 57 having ports **57*a* and 57*b* adjacent opposite ends, and a piston 58 movable in the cylinder and having a piston rod member 58*a* extending out of one end of the cylinder. In the embodiment of the valved dispenser assembly shown in FIGS. 3 and 4, the cylinder 57 is mounted by a cross head 61 and legs 62 on the dispenser body 41 for movement therewith with the piston rod member 58*a* aligned with the rod 53. The piston rod member 58*a* is connected at 58*b* to the rod 53 to move the rod 53** relative to the dispenser body and thereby move the dispenser valve between its open and closed positions.

In the embodiment of FIGS. 5 and 6, the fluid pressure operated valve actuator 56' includes a cylinder 57' having ports **57*a*' and 57*b*' adjacent opposite ends and a piston 58' movable in the cylinder and having a piston rod member 58*a*' extending out of one end of the cylinder. One end of the cylinder is mounted by a pivot bolt 60' on a head 61' attached to the rod 53' so that the cylinder moves vertically with the dispenser body 41'. The piston rod member 58*a*' is connected at 58*b*' to an arm 63** that extends outwardly from the valve member to move the valve member angularly between its open and closed positions.

Figure 7:
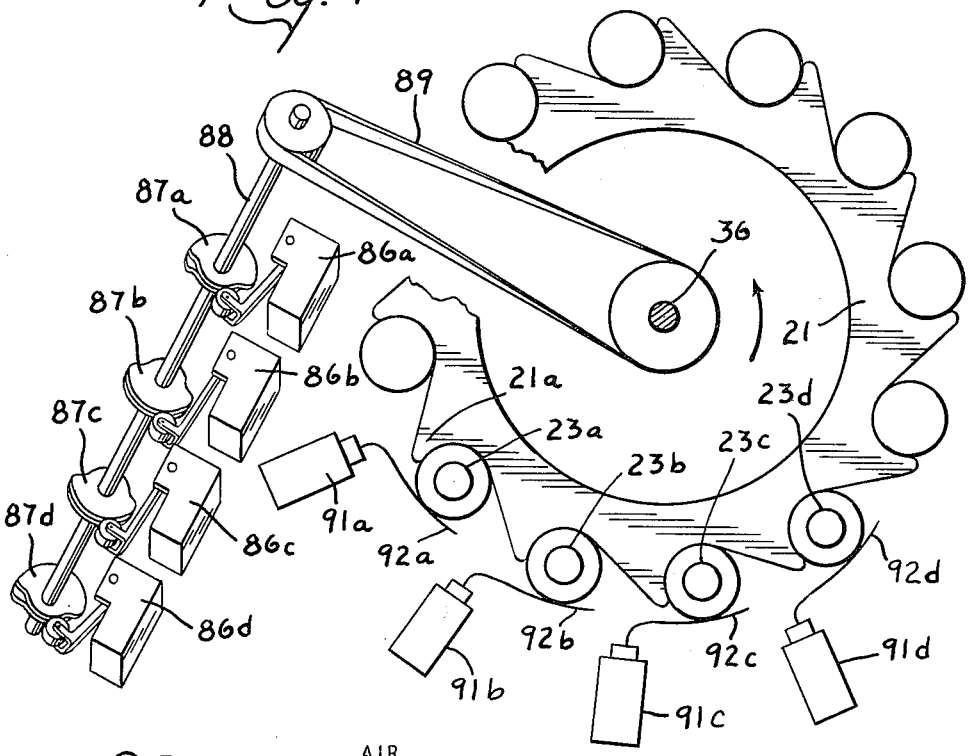
FIG. 7 is a diagrammatic view of a control system for operating the dispenser valves in timed relation with a conveyor.
Figure 8:
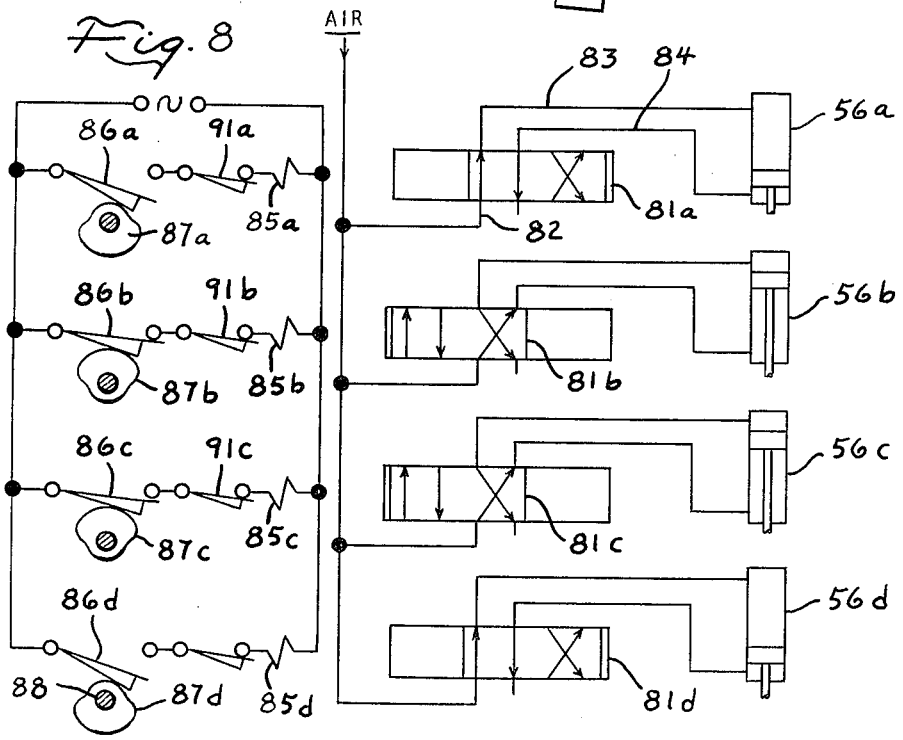
FIG. 8 is an electrical and pneumatic circuit diagram of the control system for the valved dispenser apparatus.

A control system for operating the valved dispenser assemblies in timed relation with the movement of the dispenser assemblies in their closed loop course is diagrammatically illustrated in FIGS. 7 and 8. The filling machine described above has four valved dispenser assemblies 23a–23d and the control system is arranged to control application of fluid pressure to four fluid pressure operated valve actuators 56a–56d respectively associated with the dispenser assemblies 23a–23d. As shown in FIG. 8, four fluid control valves 81a–81d are provided for reversibly supplying fluid pressure to the actuators 56a–56d respectively. The fluid control valves 81a–81d are of the four-way two-position type and each have an inlet 82 connected to a source of fluid pressure such as a compressed air supply, and controlled outlet lines 83 and 84 connected to the ports 57a and 57b on a respective one of the actuators 56a–56d. The fluid control valves 81a–81d have operators 85a–85d respectively which are operative to move the valve members from a first position supplying fluid pressure to the outlet line 83 leading to one of the cylinder ports 57a to a second position supplying fluid pressure to the outlet 84 line leading to the other of the cylinder ports 57b. The valve operators 85a–85d are conveniently of the electrical or solenoid type, it being understood that fluidic type valve operators could also be used. The valve actuators 85a–85d are energized in timed relation with the movement of the associated dispenser assembly 23a–23d and, as diagrammatically illustrated in FIGS. 7 and 8, are actuated by switches 86a–86d respectively operated by cams 87a–87d mounted on a cam shaft 88 driven by a speed reducing drive 89 from the filling machine drive shaft 36. As previously described, the conveyor 21 and valved dispenser assemblies 23a–23d are driven from the shaft 36 in timed relation with each other and such that the cranks that drive the dispenser assemblies complete one revolution during the time the conveyor advances a distance corresponding to twice the pitch distance of the conveyor teeth 21a. The speed reducing drive 89 is arranged to drive the cam shaft through one revolution during the time the dispenser assemblies move through one complete closed loop course. As previously described, each valved dispenser can dispense product only during the lower half of its closed loop course and two of the valved dispenser assemblies 23b and 23c are driven 180° out of phase with the other two dispenser assemblies 23a and 23d so that, when two valve dispensers start movement through the lower half of their closed loop course, two other valved dispensers start movement through the upper half of their closed loop course. The cam operated switches 86b and 86c associated with the valve actuators for dispenser assemblies 23b and 23c are accordingly operated substantially 180° out of phase with the cam operated switches 86a and 86d associated with the valve actuators for dispenser assemblies 23a and 23d, so that the dispenser valves on dispenser assemblies 23b and 23c are closed when the dispenser valves on dispenser assemblies 23a and 23d are open and vice versa.

The fluid pressure operated valve actuators effect a relatively rapid movement of the associated dispenser valves to their fully open and fully closed positions. It is desirable to precisely control the point at which the dispenser valves open and close so that one dispenser valve opens when another dispenser valve closes, to obtain uniform rate of flow from the associated product pump. For this purpose, the cams 87a–87d are preferably of a type which is adjustable to vary both the point during each revolution at which the cam actuates its switch and the point at which the switch is deactuated. The adjustable cams may, for example, be of the type disclosed in U.S. Pat. No. 3,958,463 to which reference is made for a more complete disclosure. In general, each cam includes two cam members having lobes that extend through somewhat less than 180° and which cam members are angularly adjustable relative to the cam shaft and to each other. With this arrangement, one cam member can be angularly adjusted on the shaft to control the point at which its switch is actuated and the other cam member angularly adjusted to control the point at which its switch is deactuated.

Provision is also advantageously made for preventing dispensing of product from a dispenser assembly when there is no container in filling position on the conveyor as it moves past the dispenser apparatus. The presence or absence of a container can be detected in any suitable manner and may, for example, be detected mechanically or photoelectrically. As diagrammatically shown in FIG. 7, the presence or absence of a container in filling position below the several dispenser assemblies is sensed mechanically as by resilient switch actuators 92a–92d on switches 91a–91d respectively. The switches 91a–91d are connected in series with the valve operators 85a–85d respectively and are arranged to close when the associated switch actuator 92a–92d senses a container and to open in the absence of a container to prevent actuation of the associated dispenser valve to its open position.

From the foregoing it is believed that the construction and operation of the filling machine will be readily understood. The fluid pressure operated valve actuators 56a–56d effect a relatively rapid movement of the associated dispensing valves between their fully open and fully closed position so that the dispenser valves are in a fully opened condition during substantially the entire half of the closed loop course during which product is dispensed from the dispenser assembly. In the filling machine disclosed having several dispenser assemblies dispensing product from a common pump and moving in closed loop courses of phase with each other, the opening and closing of the valves on the several dispenser assemblies can be timed with relation to movement of the dispenser assemblies and with each other so that the dispenser valve on one dispenser assembly is moved to its fully open position as the dispenser valve on another dispenser assembly is closed, to thereby achieve substantially uniform rate of product flow from the product supply pump. Switches 91a–91d connected in circuit with the actuators for the fluid control valves 81a–81d and operated by container sensors 92a–92d provide no container-no fill operation of the filling machines.

The embodiments of the invention in which an exclusive property or privilege is claimed are defined as follows:

1. A filling machine having a stationary support structure, conveyor means for advancing containers along a generally horizontal path with adjacent containers spaced apart a preselected pitch distance, at least one valved dispenser assembly for dispensing product into containers as they are advanced by the conveyor means, the valved dispenser assembly including a dispenser body having a product inlet and a downwardly opening product outlet and dispenser valve means on the dispenser body movable relative thereto between a closed position blocking flow from the product inlet to the product outlet and an open position for passing product from the product inlet to the product outlet, dispenser mounting means including crank means mounted on the stationary support structure for rotation about a generally horizontal crank axis and having an eccentric connected to the dispenser body to move the dispenser body in a generally upright closed loop course having horizontal and vertical components of movement, means for driving the crank means in timed relation with the conveyor means and such that the horizontal component of movement of the dispenser body is in the direction of movement of the conveyor means during the lower half of the closed loop course and in the opposite direction during the upper half of the closed loop course, fluid pressure operated valve actuator means mounted on the dispenser body for movement therewith and having an output member movable relative thereto and connected to the dispenser valve means for rapidly moving the dispenser valve means to its open position when the fluid pressure operated valve actuator means is operated to a first condition and for rapidly moving the dispenser valve to its closed position when the fluid pressure operated valve actuator means is operated to a second condition, control means for controlling application of fluid pressure to said fluid pressure operated valve actuator means to operate said fluid pressure operated valve actuator means to said first condition as the dispensing body moves through at least a portion of the lower half of its closed loop course and to operate said fluid pressure operated valve actuator means to said second condition during the remainder of the closed loop course.

2. A filling machine according to claim 1 wherein said control means includes means operated in timed relation with the movement of the dispenser body in its closed loop course.

3. A filling machine according to claim 1 wherein said control means includes means for independently adjusting the time during each crank revolution at which the fluid pressure operated valve actuator means is operated to its first condition and the time during each crank revolution at which the fluid pressure operated valve actuator means is operated to its second condition.

4. A filling machine according to claim 1 wherein said control means includes a fluid control valve for controlling the application of fluid pressure to said fluid pressure operated valve actuator, and means for operating said fluid control valve in timed relation with said crank means.

5. A filling machine according to claim 4 wherein last mentioned means is adjustable to vary the position in each crank revolution at which said fluid control valve is operated.

6. A filling machine according to claim 4 wherein said control means includes means for controlling the operation of said fluid control valve to prevent operation of said fluid pressure operated valve actuator means to said first condition when a container is absent from the conveyor means as it moves past the dispenser body.

7. A filling machine according to claim 1 wherein said control means includes means for controlling application of fluid pressure to said valve actuator means to prevent operation of said fluid pressure responsive valve actuator means to said first condition when a container is absent from the conveyor means as it moves past the dispenser body.

8. A filling machine according to claim 1 wherein said dispenser mounting means includes a dispenser motion control means mounted on the stationary support structure for angular oscillation about a generally horizontal swing axis above said crank axis, and means connecting the dispenser body and the dispenser motion control means for relative sliding movement to cause the dispenser body to oscillate angularly about the swing axis as it is moved in said closed loop course.

9. A filling machine according to claim 1 wherein said filling machine includes at least a second one of said valved dispenser assemblies having a second fluid pressure operated valve actuator means, said valved dispenser assemblies being spaced apart in a direction paralleling the conveyor path a distance equal to a multiple of the conveyor pitch distance, crank means for driving the second valved dispenser assembly in a closed loop course 180° out of phase with the first mentioned valved dispenser assembly, said control means including means for controlling application of fluid pressure to said first and second fluid pressure operated valve actuator means in timed relation with the movement of the first and second dispenser assemblies in their closed loop courses and substantially 180° out of phase with each other.

10. A filling machine according to claim 1 wherein said filling machine includes a second, and third and a fourth one of said valved dispenser assemblies, said valved dispenser assemblies being spaced apart in a direction paralleling said path a distance equal to the conveyor pitch distance, and means for driving said second, third and fourth valved dispenser assemblies in predetermined phase relation with the first mentioned valved dispenser assembly such that the two of valved dispenser assemblies sequentially dispense product into the one container as it is advanced by the conveyor means and two other of valved dispenser assemblies sequentially dispense product into an adjacent container as it is advanced by the conveyor means.

11. A filling machine having a stationary support structure, conveyor means for advancing containers along a generally horizontal path with adjacent containers spaced apart a preselected pitch distance, at least first and second valved dispenser assemblies for dispensing product into containers as they are advanced by the conveyor means, each valved dispenser assembly including a dispenser body having a product inlet and a downwardly opening product outlet and each valve dispenser assembly having a dispenser valve means on the dispenser body movable relative thereto between a closed position blocking flow from the product inlet to the product outlet and an open position for passing product from the product inlet to the product outlet, first and second dispenser mounting means each including crank means mounted on the stationary support structure for rotation about a generally horizontal crank axis and each having an eccentric connected to a respective one of the dispenser bodies to move the dispenser body in a generally upright closed loop course having horizontal and vertical components of movement, means for driving the crank means of the first and second dispenser mounting means in timed relation with the conveyor means and 180° out of phase with each other and such that the horizontal component of movement of the associated dispenser body is in the direction of movement of the conveyor means during the lower half of the closed loop course and in the opposite direction during the upper half of the closed loop course, common product supply means for supplying product to both the first and second valve dispenser assemblies, first and second fluid pressure operated valve actuator means respectively mounted on the dispenser body of the first and second valved dispenser assemblies for movement therewith and having an output member movable relative thereto and connected to the associated dispenser valve means for rapidly moving the dispenser valve means to its open position when the fluid pressure operated valve actuator means is operated to a first condition and for rapidly moving the dispenser valve to its closed position when the fluid pressure operated valve actuator means is operated to a second condition, control means for controlling application of fluid pressure to said first and second fluid pressure operated valve actuator means in timed relation to the movement of said first and second dispenser assemblies in their closed loop courses and substantially 180° out of phase with each other to operate said fluid pressure operated valve actuator means to said first condition as the dispenser body moves through at least a portion of the lower half of its closed loop course and to operator said fluid pressure operated valve actuator means to said second condition during the remainder of the closed loop course.

12. A filling machine according to claim 11 wherein said control means includes means for independently adjusting the time during each crank revolution at which the first and second fluid pressure operated valve actuating means are operated to their first condition and the time during each crank revolution at which the first and second fluid pressure operated valve actuating means are operated to their second condition.

13. A filling machine according to claim 12 including means for controlling the application of fluid pressure to the first and second pressure responsive valve actuator means to prevent operation of the valve actuator means on the first and second dispenser assemblies when a container is absent from the conveyor as it moves past the first and second dispenser assemblies.

* * * * *

UNITED STATES PATENT AND TRADEMARK OFFICE

CERTIFICATE OF CORRECTION

PATENT NO. : 4,394,876

DATED : July 26, 1983

INVENTOR(S) : Jonathan G. Brown

It is certified that error appears in the above--identified patent and that said Letters Patent are hereby corrected as shown below:

Claim 11, column 11, line 17, "operator" should be -- operate --.

Signed and Sealed this

First Day of November 1983

[SEAL]

*Attest:*

GERALD J. MOSSINGHOFF

*Attesting Officer*

*Commissioner of Patents and Trademarks*